United States Patent [19]

Zander

[11] Patent Number: 4,465,390

[45] Date of Patent: Aug. 14, 1984

[54] PRINTER COMPRISING A NOISE-SEALING PAPER-TRANSPORT ROLLER

[75] Inventor: Hendrik J. Zander, Beekbergen, Netherlands

[73] Assignee: U.S. Philips Corporation, New York, N.Y.

[21] Appl. No.: 481,708

[22] Filed: Apr. 4, 1983

[30] Foreign Application Priority Data

Apr. 19, 1982 [NL] Netherlands ..... 8201612

[51] Int. Cl.[3] ..... B41J 29/08

[52] U.S. Cl. ..... 400/689; 181/201

[58] Field of Search ..... 400/689, 690, 690.1, 400/690.2, 690.3, 690.4; 181/198, 200, 201, 205

[56] References Cited

U.S. PATENT DOCUMENTS

| | | | |
|---|---|---|---|
| 3,122,228 | 2/1964 | Dollenmayer et al. | 400/690 |
| 3,513,938 | 5/1970 | Buehner et al. | 400/690.1 |
| 4,197,024 | 4/1980 | Hantoon | 400/689 |

FOREIGN PATENT DOCUMENTS

| | | | |
|---|---|---|---|
| 2706209 | 8/1978 | Fed. Rep. of Germany | 400/690 |
| 101486 | 8/1980 | Japan | 400/690 |
| 155779 | 12/1981 | Japan | 400/689 |

OTHER PUBLICATIONS

Rupe et al., Acoustic Filters for Impact Printers, IBM Tech. Disclosure Bulletin, vol. 23, No. 8, Jan. 1981, pp. 3524–3525.

*Primary Examiner*—Edgar S. Burr
*Assistant Examiner*—M. J. Hirabayashi
*Attorney, Agent, or Firm*—David R. Treacy

[57] ABSTRACT

A printer in which paper transport takes place from a sealed entrance opening in a housing to the printing area, and then to a sealed exit opening of the housing. The entrance and exit opening is sealed against escape of noise by a rotatable cylindrical friction roller located between the incoming and outgoing portions of the paper strip, during printing the roller being pulled by tensile stress in a paper against wall portions on the outer side of the housing.

8 Claims, 4 Drawing Figures

PRINTER COMPRISING A NOISE-SEALING PAPER-TRANSPORT ROLLER

BACKGROUND OF THE INVENTION

The invention relates to a printer comprising a paper-transport device for the transport of a paper strip from an entrance opening in a housing of the printer to the printing area and thence to an exit opening of the housing, and a noise-barrier arranged between the entrance opening and the exit opening.

In a known printer of this kind (known from "IBM Technical Disclosure Bulletin", Vol. 23, no. 8, January 1981, p. 3524–3525), the noise-absorber comprises a holder filled with a noise-absorbing synthetic foam material. The walls of the holder facing the interior of the printer are provided with openings through which the noise produced in the printer is admitted into the noise-absorbing substance.

A disadvantage of the known printer is that both the entrance opening and the exit opening form an opening through which noise escapes. The noise-absorber, which lies between the portions of the paper strip that are entering and leaving the printer, absorbs only a part of the noise produced in the printer. A considerable part of the noise reaches the surroundings of the printer through the entrance and exit openings.

SUMMARY OF THE INVENTION

The invention has for its object to provide a printer of the above kind in which the amount of noise reaching the surroundings of the printer through the entrance and exit openings is considerably reduced.

A printer according to the invention is characterized in that the noise-barrier comprises at least a rotatably arranged friction roller which, both at the area of the entrance opening and at the area of the exit opening, is pressed toward wall portions of the housing, on the outer side of the housing, at the area of the entrance opening and at the area of the exit opening by the tensile force which is exerted on the paper strip inside the housing for the transport of the strip, the arrangement being such that the incoming and outgoing portions of the paper strip are subjected on their sides which are remote from each other to a frictional braking force by said wall portions.

Due to the fact that the friction roller closes the entrance opening and the exit opening completely at the area of the paper transport, the amount of noise reaching the surroundings of the printer through the entrance and exit openings is comparatively small. Also, the noise which is conducted to the exterior by longitudinal and/or lateral vibrations in the paper itself is strongly damped by the friction roller being pressed against the wall portions on the outer side of the housing.

It should be noted that the West German Patent Application 2,706,209 describes a noise-seal for a printer, in which the slot at the area at which the paper leaves is covered by a resiliently engaging closure member which is opened electromagnetically when paper transport has to take place. However, it has been found that a considerable prt of the noise produced in a printer comes just from the paper transport. In the known printer, the noise produced by the paper transport can escape without hindrance. Moreover, an electromagnetically actuated closure member is comparatively expensive. This known noise-seal furthermore cannot be used in printers in which a continuous paper transport takes place.

A preferred embodiment of the printer according to the invention is characterized in that the friction roller comprises at least a layer of a resilient material.

In such a printer, the friction roller performs, in addition to the function of noise-barrier, a second function of paper puller. If it is arranged that the resilient compression of the resilient material at the area of the entrance opening is greater than the resilient compression at the area of the exit opening, a frictional driving force will be exerted by the roller on the side of the paper facing the roller at the exit opening, and as a result a comparatively large tensile force will be exerted on the paper passing through the exit opening. Thus, the paper extending between the printing area and the exit opening is kept under tension. This is especially important if a paper strip with sharp folds (a so-called "chain-form") is used. These folds are then pulled out so that the probability of their disturbing the paper transport is reduced.

A further embodiment of the printer according to the invention which is suitable for feeding-in and feeding-out paper at the back of the printer is characterized in that one of said wall portions substantially coincides with a horizontal first plane which is tangential to the friction roller, and the other of said wall portions substantially coincides with a vertical second plane which is tangential to the friction roller.

Yet another embodiment of the printer according to the invention is characterized in that the friction roller is journalled with clearance in bearing openings in the housing wall. The clearance in the journalling of the friction roller renders the latter self-adjusting and avoids having to take narrow tolerances into account in the journalling of the friction roller during the manufacture of the printer.

A further embodiment of the printer according to the invention which is suitable for different paper widths is characterized in that the noise-barrier comprises a number of sub-rollers which are rotatable on a common supporting shaft.

Yet another embodiment of the printer according to the invention is characterized in that the friction roller comprises a porous resilient layer on which is provided a material for increasing the friction coefficient of the roller. By giving the friction roller a comparatively high friction coefficient with respect to the paper, the risk of slip occurring between the paper and the friction roller at the entrance opening for the paper is reduced. The porous layer ensures a satisfactory adhesion to the said material.

An embodiment of the invention will be described more fully with reference to the drawing.

DESCRIPTION OF THE PREFERRED EMBODIMENTS

Figure 1:
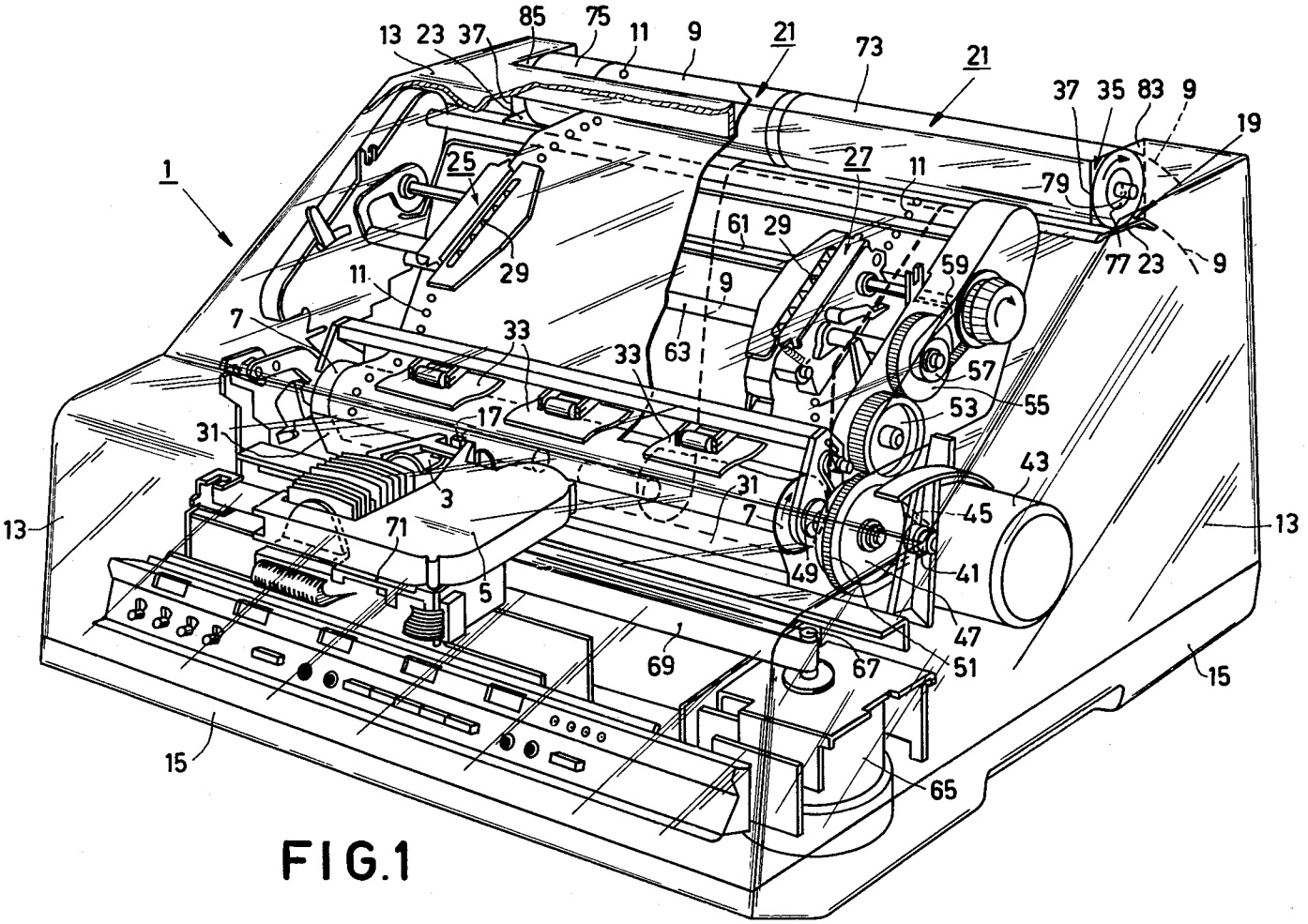
FIG. 1 is a perspective view of a preferred embodiment of a printer according to the invention.

The printer 1 shown in FIG. 1 comprises a matrix printing head 3 which can be moved in reciprocal directions along a printing line and comprises printing styli which can be electromagnetically actuated and which, with the interposition of an ink ribbon stored partly in an ink-ribbon cassette 5, strike against a rotatably arranged cylindrical anvil 7 around which passes a so-called "chain-form" 9 (paper strip with edge perforations 11). The printing head 3 is of a kind which is known per se and which prints characters composed of a matrix of dots. The printer comprises a hood 13, which includes essential parts of a paper-transport mechanism which will be described hereinafter. The printer also comprises a base 15 on which the hood 13 is mounted in a sound-proof manner. The hood 13 and the base 15 together constitute the housing of the printer 1. The hood 13 can be wholly transparent or partly transparent, for example, at the printing area 17. On the inner side the hood 13 can be coated with a sound-absorbing material.

Figure 2:
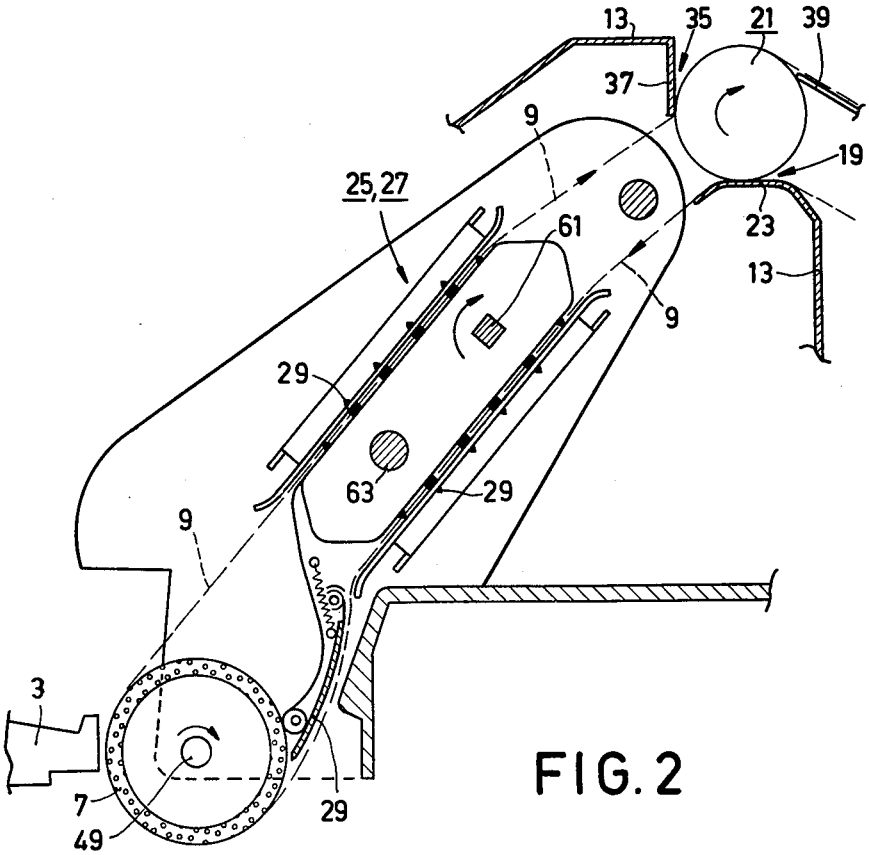
FIG. 2 shows diagrammatically a part of the printer of FIG. 1.

As can be seen from FIGS. 1 and 2, the paper strip 9 is fed into the printer 1 through an entrance opening 19 between a cylindrical friction roller (noise barrier) 21 and a horizontal wall portion 23 of the housing (13, 15). The paper strip 9 can be supplied from a stack (not shown) of fan-fold paper. From the entrance opening 19 the paper strip 9 passes at its left- and right-hand edges through traction devices 25 and 27, respectively, the perforations 11 in the edges of the strip being engaged by the teeth 29 of the traction devices at the lower sides thereof (not visible in FIG. 1). The traction devices 25 and 27 are of any kind which is known per se. After passing through these devices 25 the paper strip 9 is guided by paper guides 29 (FIG. 2) and 31 (FIG. 1) around the anvil 7 to the level of the printing area 17. Subsequently, paper guides 33 (FIG. 1) guide the paper strip to the upper sides of the traction devices 25 and 27, where the teeth 29 likewise engage with the edge perforations 11 in the strip. The paper strip 9 then passes to an exit opening 35 between the friction roller 21 and a vertical wall portion 37 of the hood 13 of the housing (13, 15). From the exit opening 35 the paper strip 9 is fed out by the friction roller 21 to an external paper guide 39 (FIG. 2).

Through a toothed belt 45 a toothed driving shaft 41 of an electric motor 43 drives a toothed pulley 47. The pulley 47 is fixed on a rotatable shaft 49 on which the cylindrical anvil 7 is secured. The pulley 47 is fixed to a toothed wheel 51 which meshes with a toothed wheel 53. The toothed wheel 53 meshes with a toothed wheel 55 which is fixed to a toothed pulley 57 around which passes a toothed belt 59. The toothed belt 59 drives a further toothed pulley (not shown in FIG. 1), which is secured on a square driving shaft 61 for the two traction devices 25 and 27. These devices are adjustable along the driving shaft 61 and the guiding shaft 63 to suit the paper width. The movement of the printing head 3 along the printing line is obtained by means of a reversible electric motor 65, whose output shaft is provided with a toothed pulley 67 which drives a toothed belt 69. The toothed belt 69 is secured to a carriage 71 on which the printing head 3 is mounted.

Figure 4:
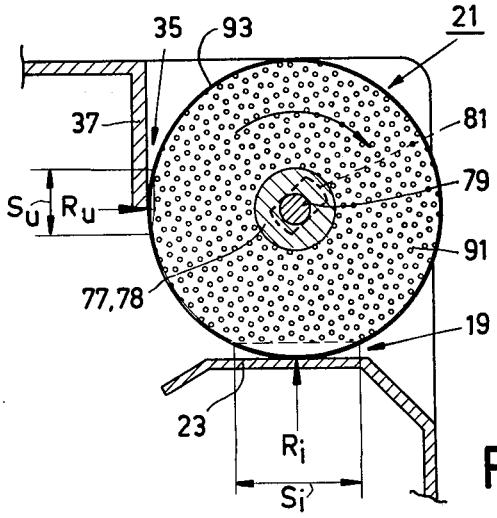
FIG. 4 shows to an enlarged scale a cross-section of the friction roller shown in FIG. 3.
Figure 3:
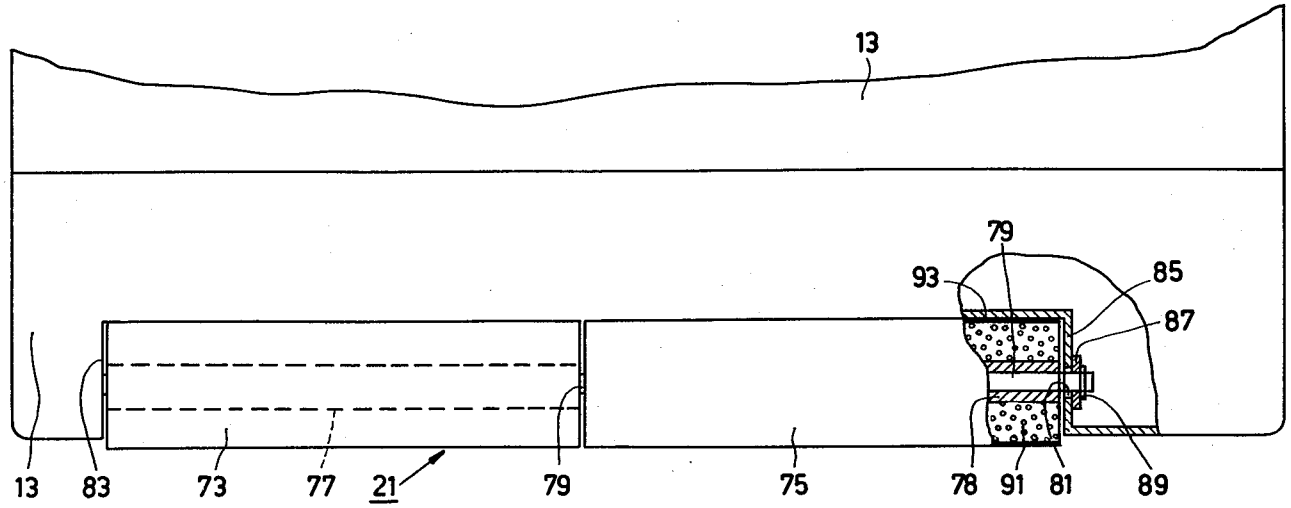
FIG. 3 shows in a partial sectional view the friction roller used in the printer shown in FIGS. 1 and 2.

In the described embodiment of the printer 1, the friction roller 21 is composed of two coaxial sub-rollers 73 and 75 made of a synthetic material which is to be defined hereinafter. The sub-rollers 73 and 75 are clamped on metal tubes 77 and 78 respectively which are freely rotatable about a shaft 79 (see FIGS. 1 and 3). At its ends the shaft 79 is journalled so as to be freely rotatable in slots—such as the slot 81 shown in FIG. 4—which are provided in vertical wall portions 83 and 85 of the hood 13. The shaft 79 is held at each end in the axial direction by a spacer ring 87 and spring clip 89 (only one spacer ring and one spring clip are shown in FIG. 3). For the sake of simplicity, where possible, the friction roller 21 is hereinafter considered to be a one-piece roller.

When the cylindrical anvil 7 is driven by the motor 43 in the direction indicated by the arrows in FIGS. 1 and 2, at the area of the entrance opening 19 the paper strip 9 is subjected to a tensile force which rotates the friction roller 21 about the shaft 79. The friction between the paper strip 9 and the roller 21 has to be sufficiently high for this purpose. The friction between the paper strip 9 and the horizontal wall portion 23 on the other hand has to be sufficiently low in order not to hinder unnecessarily the sliding of the paper strip 9 over the wall portion 23. The part of the paper strip 9 which extends between the lower sides of the traction devices 25 and 27 and the entrance opening 19 is constantly subjected to a tensile stress due to the driving effect both of the anvil 7 and of the traction devices 25 and 27. The tensile stress in the paper strip 9 between the traction devices 25 and 27 and the entrance opening 19 also ensures that the friction roller 21 is pressed against the vertical wall portion 37 at the area of the exit opening 35. This means that the roller 21 at the area of the exit opening 35 exerts a tensile force on the part of the paper strip 9 which extends between the upper sides of the traction devices 25 and 27 and the exit opening 35. It can then be assumed that the friction between the paper strip 9 and the vertical wall portion 37 is substantially equal to that between the paper strip 9 and the horizontal wall portion 23 so that the sliding of the paper strip is not unnecessarily hindered. Moreover, the friction between the paper strip 9 and the roller 21 at the area of the exit opening 35 is so high that no slip occurs between the paper strip 9 and the roller 21 at this area. Since no slip occurs between the roller 21 and the paper strip 9 at the area of the entrance opening 19 also, equal lengths of the paper strip 9 pass per unit time through the entrance opening 19 and through the exit opening 35. This is the case both with a hard roller 21 which is subjected to no resilient compression and with the resilient roller 21 to be described hereinafter.

The roller 21 acts effectively as a wedge between the wall portions 23 and 37, with the result that a complete closure is obtained at the area of the entrance opening 19 and the exit opening 35 throughout the length of the roller 21. The amount of noise that can reach the surroundings of the printer during the feeding-in and feeding-out of the paper is therefore substantially limited to a minimum. Only in the vicinity of the ends of the roller and of the division between the two sub-rollers does a comparatively small amount of noise escape. The roller 21, however, not only has a noise-sealing function but also guarantees that the part of the paper strip 9 which extends between the traction devices 25 and 27 and the exit opening 35 is continuously subjected to tensile stress. This is especially important when chain-forms are used. The folds present in these chain-forms are pulled out so that the risk of obstruction is reduced. In practice, it may occur that due to frictional variations at the area of the exit opening 35 the paper strip 9 is not pulled sufficiently at the exit opening 35. An additional paper puller near the exit opening can, of course, preclude any risk of obstruction. However, preferably a friction roller 21 is used which is provided with a resilient layer 91 (see FIGS. 3 and 4). The effect of such a resilient layer 91 is that at the area of the exit opening 35 a comparatively large tensile force is exerted by the friction roller 21 on the paper strip 9. This is due to the slip now occurring at the area of the exit opening 35 between the roller 21 and the paper strip 9. This slip is introduced intentionally by arranging for the resilient compression of the roller 21 at the area of the entrance opening 19 to be different from that at the area of the exit opening 35. To achieve this the reaction forces $R_i$ and $R_u$ (see FIG. 4) of the horizontal and vertical wall portions 23 and 37, respectively, have to be different, namely $R_i > R_u$. If this relationship is satisfied, the resilient compression and therefore the flattening $S_i$ of the roller 21 at the area of the entrance opening 19 is larger than the resilient compression and hence the flattening $S_u$ at the area of the exit opening 35. Consequently, slip has to occur at the area of the exit opening 35 in order to compensate for the difference between $S_u$ and $S_i$. This slip results in a comparatively large tensile force being exerted on the part of the paper strip 9 which extends between the traction devices 25 and 27 and the exit opening 35. The ratio between $R_i$ and $R_u$ is very dependent upon the weight of the friction roller 21, upon the direction and the value of the tensile stress in the paper at the area of the entrance opening 19 and at the area of the exit opening 35, upon the angle between the wall portions 23 and 37 (in the present case $\pi/2$ radians) and upon the friction between the paper strip 9 and the friction roller 21 and the wall portions 23 and 37, respectively. Although the direction and the value of the tensile stress in the paper at the area of the entrance opening 19 and at the area of the exit opening 35 is often already defined by the geometry of the printer and/or the kind of the paper drive, mostly the requirement that $R_i > R_u$ can nevertheless be satisfied by adapting the weight of the friction roller 21.

It is necessary that at the beginning of the paper transport, when comparatively large accelerations occur, no slip is allowed between the friction roller 21 and the paper strip 9 at the area of the entrance opening 19. If slip does occur the friction roller 21 will not follow the rotation sufficiently and may even remain stationary in the case of a somewhat heavier roller. The printer then becomes filled with paper. To avoid this the friction between the paper strip 9 and the friction roller 21 has to be comparatively high. In a preferred embodiment, this is achieved by spraying on the outer side of the resilient material 91 a thin layer 93 of synthetic material which has a comparatively high friction coefficient with respect to paper which remains very constant. It is necessary that the synthetic material 93 applied by spraying adheres satifactorily to the resilient material 91. For this reason, preferably a porous synthetic material is used for the resilient material 91. In practice, a suitable combination has proved to be a polyurethane foam on the basis of polyester or polyol as a porous resilient material 91 with a coating of a two-component polyurethane foam having a thickness of 50 $\mu$m.

In practice, the friction roller 21 is divided into a plurality of sub-rollers adapted having lengths selected optimally to match the usual or common paper widths. For the sake of simplicity, in FIGS. 1 and 3 the roller is shown divided into two sub-rollers 73 and 75. the sub-rollers 73 and 75 are each clamped on an individual metal tube 77 and 78, respectively, which tubes are freely rotatable about one continuous shaft 79. The divided friction roller 21 has the advantage that with a paper strip having a comparatively small width it is not necessary to overcome the friction exerted by the hood 13 throughout the length of the friction roller. Only the sub-rollers which are in contact with the paper are rotated, the other sub-rollers remaining stationary. Moreover, the possibility of displacement of the paper strip in a direction at right angles to the transport direction of the paper strip is reduced in the case in which the paper strip is asymmetrical to the friction roller. Such a displacement in fact occurs upon tilting of the shaft 79 in the slots 81.

The invention is not limited to printers in which the wall portions 23 and 37 enclose an angle with each other of $\pi/2$ radians, although a rectangle is advantageous in those printers in which the paper is fed in and fed out at the back of the printer. The angle between the wall portions 23 and 37 may be either acute or obtuse, and the wall portions 23 and 37 may, for example, also be located on the upper side of the printer. Neither of the wall portions 23 and 37 therefore need be located in a vertical or horizontal plane.

Although the invention is described for a printer in which the friction roller is suspended in the existing housing of the printer, it is not limited thereto. The friction roller may be mounted in a separate housing or in a separate hood which is built around the printer already provided with its own hood or housing. In this manner, standardization and mass production can be attained.

The shaft 79, which is journalled with clearance in the slots 81 and is self-adjusting, may be replaced by a shaft which is fixedly arranged. In order to reduce tolerance problems, at any rate the use of a friction roller made of a resilient material is to be preferred to the use of a roller made of a hard material. The friction roller then permanently engages with resilience the wall portions 23 and 37. The friction roller may then also be provided with a manual drive for feeding-in and feeding-out the paper. With a self-adjusting shaft 79 and paper can be fed in and out in a simpler manner because the friction roller can be pulled away from the hood over a small distance.

The invention can be used in printers in which the paper transport is effected solely by friction rollers, by toothed wheels engaging perforations, by traction devices or by combinations of such transport mechanisms. However, the friction roller always forms part of the whole paper-transport mechanism due to its second function of paper puller. The invention can be used also in printers working with simple forms instead of chain-forms or in printers working with both kinds of forms. The invention is not limited either to printers with impact elements. Thus, the invention may be used, for example, in electrostatic printers, thermal printers or printers which print with ink droplets.

What is claimed is:

1. A printer comprising a printer housing, at least one opening in the housing for passage into and out of the housing of a paper strip to be printed upon, a paper transport device for transporting the paper strip into the housing to a printing area and then out of the housing, and a noise barrier, wherein said noise barrier comprises a roller mounted for rotation, said roller being located so as to substantially close said at least one opening, the paper strip entering said housing by passing between and in contact with the roller and a first wall of the housing at one side of said at least one opening and said paper strip exiting from said housing by passing between and in contact with the roller and a second wall of the housing at the opposite side of said at least one opening from which said paper strip entered said housing, and means for biasing said roller toward the first and second walls.

2. A printer as claimed in claim 1, wherein said roller is a friction roller, and said means for biasing comprises tensile force exerted on the paper strip inside the housing.

3. A printer as claimed in claim 2, wherein the friction roller serves also as a paper puller, and comprises at least a layer of a resilient material, the roller and said first and said second wall being arranged such that the force biasing said roller toward said first wall is greater than the force biasing said roller toward said second wall, whereby the resilient compression of the resilient material at the area of the entrance opening is greater than the resilient compression at the area of the exit opening, whereby a greater tensile force is exerted by said roller on the paper exiting from said housing than entering said housing.

4. A printer as claimed in claim 3, wherein said roller comprises a porous resilient layer including a material provided on the roller surface for increasing the friction coefficient.

5. A printer as claimed in claim 3, wherein said roller is one of a plurality of subrollers which are rotatable on a common supporting shaft, said subrollers having lengths selected to match common paper widths.

6. A printer as claimed in claim 1, wherein said first wall substantially coincides with a horizontal plane which is tangential to the friction roller, and said second wall substantially coincides with a vertical plane tangential to said roller.

7. A printer as claimed in claim 1, wherein said printer housing additionally comprises walls having bearing openings, said walls being transverse to said first wall and second wall, said roller being journalled with clearance in said bearing openings.

8. A printer as claimed in claim 1, wherein said roller is one of a plurality of subrollers which are rotatable on a common supporting shaft, said subrollers having lengths selected to match common paper widths.

* * * * *